United States Patent [19]

Chelin

[11] Patent Number: 4,614,394

[45] Date of Patent: Sep. 30, 1986

[54] DEVICE FOR CONNECTING A LOGIC CIRCUIT TO A COAXIAL CABLE

[75] Inventor: Cesare Chelin, Caluso, Italy

[73] Assignee: Ing. C. Olivetti & C., S.p.A., Ivrea, Italy

[21] Appl. No.: 675,851

[22] Filed: Nov. 28, 1984

[30] Foreign Application Priority Data

Nov. 28, 1983 [IT] Italy ..... 68247 A/83
Aug. 29, 1984 [IT] Italy ..... 67859 A/84

[51] Int. Cl.[4] ..... H01R 4/24
[52] U.S. Cl. ..... 339/97 P
[58] Field of Search ..... 339/97 R, 97 P, 98, 339/99 R

[56] References Cited

U.S. PATENT DOCUMENTS 2,970,184 1/1961 Blonder ..... 339/97 R
4,261,632 4/1981 Narozny ..... 339/97 R

*Primary Examiner*—Joseph H. McGlynn
*Attorney, Agent, or Firm*—Banner, Birch, McKie & Beckett

[57] ABSTRACT

Connection is effected by piercing the insulation of the cable by a pair of needles (36) connected to the circuit and disposed parallel to one another at a distance slightly less than the diameter of the central conductor (19) of the cable, so as to come into contact with the conductor at two diametrically opposed regions. The parts of the needles which pass through the screening braid (21) of the cable are covered with insulation (44).

Two other pairs of parallel needles (52) are disposed symmetrically either side of the first pair and are arranged in pairs at a distance corresponding to the diameter of the screening braid. All the needles are disposed on a jaw (15) adapted to receive the cable, against which a second jaw is closed when actuated by a two-position lever. This is connected to the second jaw by connecting rods which in the closed position are moved beyond a dead point.

According to a modification, the spacing of the needles (36) is kept constant by a guide cylinder, which slides axially on the needles and is urged by a spring to a position such that it guides the needles in the vicinity of the cable. The connection device is incorporated in a transceiver which is to be connected to the cable of a data transmission local area network.

14 Claims, 11 Drawing Figures

DEVICE FOR CONNECTING A LOGIC CIRCUIT TO A COAXIAL CABLE

BACKGROUND OF THE INVENTION

The present invention relates to a device for connecting a logic circuit to a coaxial cable by piercing the insulation of the cable, the device comprising an insulation-piercing contact for contacting the centre conductor of the cable and having an insulated portion which, in use, extends through the screening conductor of the cable.

Various electrical connectors are known which are adapted to be connected to a cable by piercing of the insulation. Devices are also known for connecting to coaxial cables, which usually comprise a coaxial central conductor with a screening braid disposed between two insulating layers. These connections must be very accurate and the physical and electrical characteristics of the conductor must comply with given standards.

In a known device there is provided an element for connection with the conductor, which element is adapted to pierce the two layers of insulation and the braid, while the braid is connected by flexible strips which are so disposed as to balance the bending action of the connection element on the conductor. This device has the disadvantage of being only capable of being used once because of the irreversible deformation of the strips. Furthermore, clamping is effected by means of a screw and therefore connection takes some time.

SUMMARY OF THE INVENTION

The object of the invention is to provide a device for connecting a logic circuit to a coaxial cable which allows easy, rapid and repeatable connection.

This object is met by the device according to the invention which is characterised in that the insulation-piercing contact comprises two parallel needles spaced by a distance corresponding to the diameter of the centre conductor, and further characterised by jaws operable to force the cable on to the needles so that the needles come into contact with the centre conductor at two diametrically opposed regions.

BRIEF DESCRIPTION OF THE DRAWINGS

The invention will now be described in more detail, by way of example and with reference to the accompanying drawings, in which.

DESCRIPTION OF THE PREFERRED EMBODIMENTS

An electronic apparatus 10 is to be connected to a coaxial cable 11. In particular, the apparatus 10 may be a transceiver for transmitting data, while the cable 11 is apart of a data transmission local area network, for example an arbitration network operating in accordance with a protocol known in the art by the commercial name "Ethernet". As is known, such a network includes a coaxial cable which runs through the locations served and allows connection of the various work stations or terminals through a corresponding transceiver 10 at any point on the cable 11.

Figure 1:
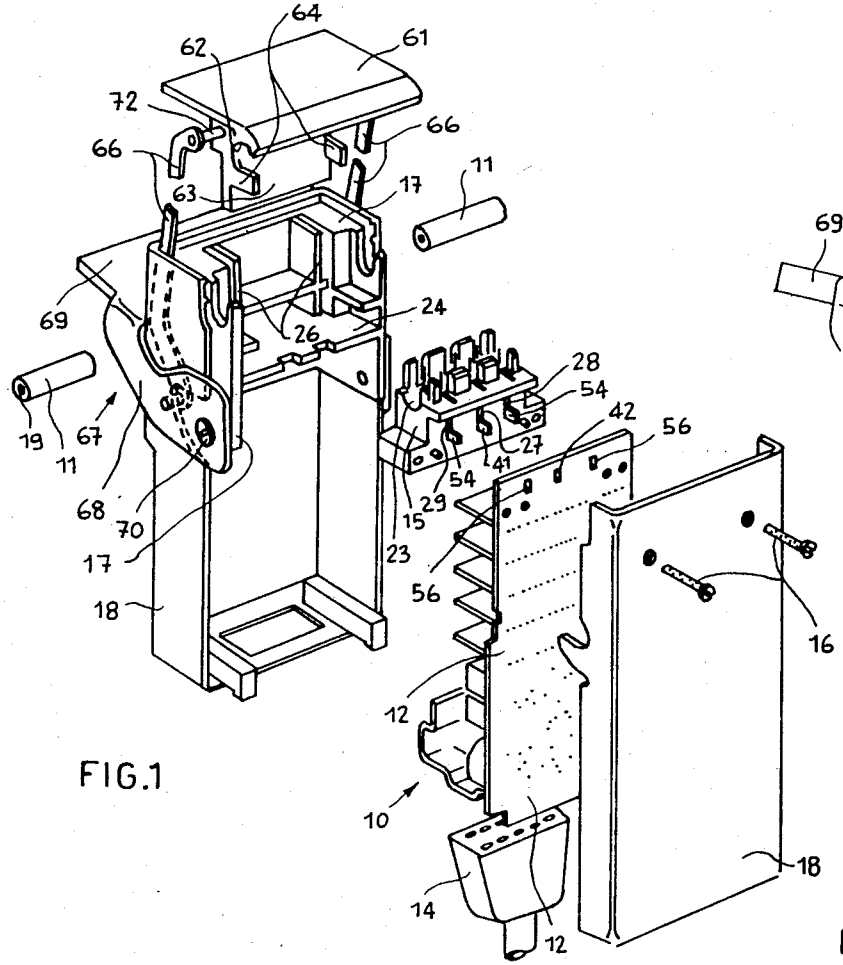
FIG. 1 is an exploded perspective view of an electronic apparatus incorporating a connecting device according to the invention.

The transceiver 10 is constituted essentially by a logic circuit on a card 12 which also carriers the respective electrical supply and includes an interface constituted by a plurality of terminals to which the terminals of the work station are connection by a connector 14 (FIG. 1).

As will be better seen from the following, the card 12 is fixed to an insulating block 15 of a support for the elements for connecting to the cable 11, by means of a pair of screws 16 (FIG. 1). The block 15 is fixed to an insulating support 17 which constitutes the fixed frame of the device. The block 15 and the support 17 are preferably of plastics material loaded with glass, or of acetal resin. The support 17 and the card 12 are covered by a security box 18, of self-extinguishing resin for example. The coaxial cable 11 is constituted by a central conductor 19 (FIG. 2) of copper having a well defined diameter, for example about 2.2 mm, which is sheathed by a first layer 20 of dielectric material, or insulation, with a thickness of about 2 mm.

The cable 11 is moreover screened by a braid 21, for example of copper, which is in turn covered by an outer sheath 22 which is also insulating.

Figure 3:
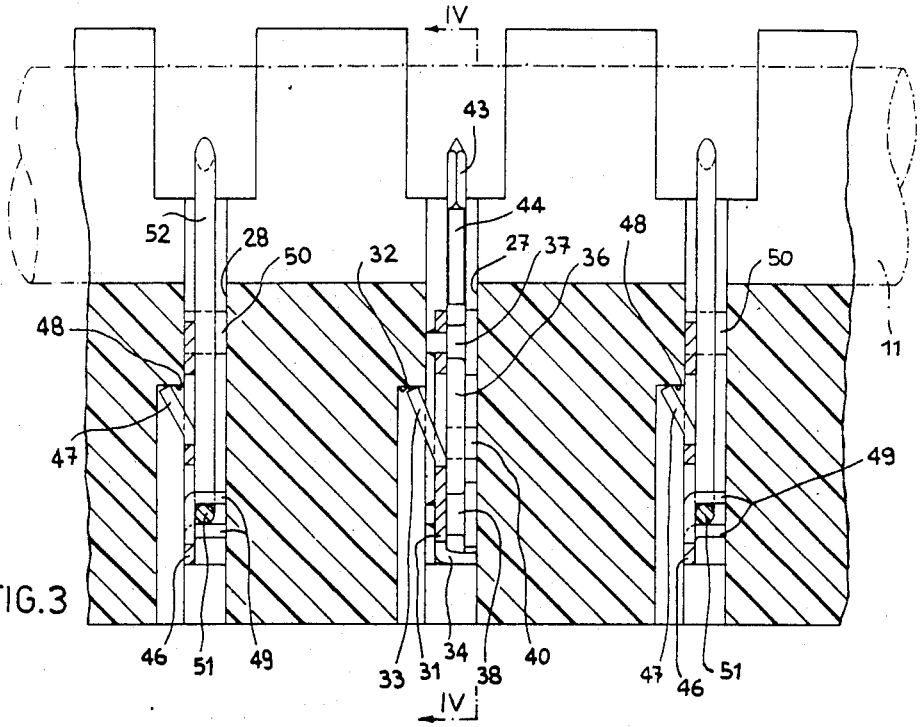
FIG. 3 is a section on a larger scale of a detail of FIG. 2.

The block 15 constitutes a first jaw having a semi-cylindrical seat 23 for the cable 11. The block 15 is adapted to be accommodated in a space 24 in the support 17 so as to leave a space between its left-hand surface 25 and a pair of shoulders 26 (FIG. 1) of the support 17. The block 15 is provided with three transverse slots 27, 28 and 29 (FIG. 3). In the slot 27 there is located a metal strip 31 which is latched against a shoulder 32 of the slot 27 by the action of a resilient bent tab 33.

Figure 4:
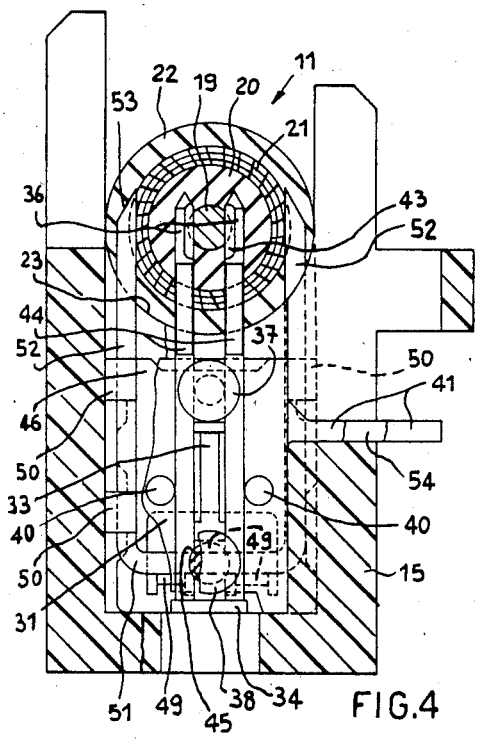
FIG. 4 is a section taken at the line IV—IV of FIG. 3.

Lower down the strip 31 has a bent tab 34 which supports a pair of electrical connection elements, each constituted by a needle 36 of, for example, spring steel. The two needles 36 (FIG. 4) are held parallel with one another at a distance slightly less than the diameter of the central conductor 19. For such purpose, the strip 31 carries a pair of pins 37 and 38 which are aligned vertically and are each provided with a stop neck for the needles 36. A pair of pins 40 aligned horizontally on the strip 31 are adapted to act as pivots for the needles 36 when they are urged to bend outwards, as will be better seen from the following. Finally the strip 31 includes an appendage 41 which is soldered to a terminal 42 (FIG. 1) of the printed circuit on the card 12.

The needles 36 (FIG. 4) end at the top with a conical point and having a portion 43 which is partly prismatic, i.e. is constituted by two plane faces at 90°, for engaging the conductor 19 with the angle between the two plane faces. Each needle 36 also has a portion 44 covered with a layer of insulation to prevent electrical contact between the braid 21 and the needles 36. Finally to hold the needles 36 in the correct orientation, the neck of the pin 38 has a diameter slightly larger than that of the pin 37, while each needle 36 is provided with a channel 45 which engages in the neck of the pin 38 so that the two needles 36 are always kept orientated, i.e. face to face in reciprocally symmetrical position.

The two slots 28 and 29 (FIG. 3) are equidistant from the slot 27. In each of the slots 28 and 29 another metal strip 46 is located which is held in position by a resilient tab 47 engaged with a shoulder 48 of the block 15. The stirp 46 is provided with three lower bent tabs 49 and three vertical tabs 50 between which a contact element 51 for connecting the circuit of the card 12 to the braid 21 of the cable 11 is engaged. Each element 51 is for example of spring steel and has the form of a U which forms two needles 52 each ending with an obliquely shaped tip 53. The two needles 52 are mutually spaced by slightly less than the diameter of the braid 21 so that they are adapted to penetrate the outer insulation 22 and to come into contact with the braid 21. Each strip 46 is provided with an appendage 54 adapted to be soldered to a suitable terminal 56 of the card 12 (FIG. 1).

The slots 27, 28 and 29 (FIG. 3) are extended downwards to allow removal of the strips 31, 46 by operation of a tool on the tabs 33, 47.

Figure 2:
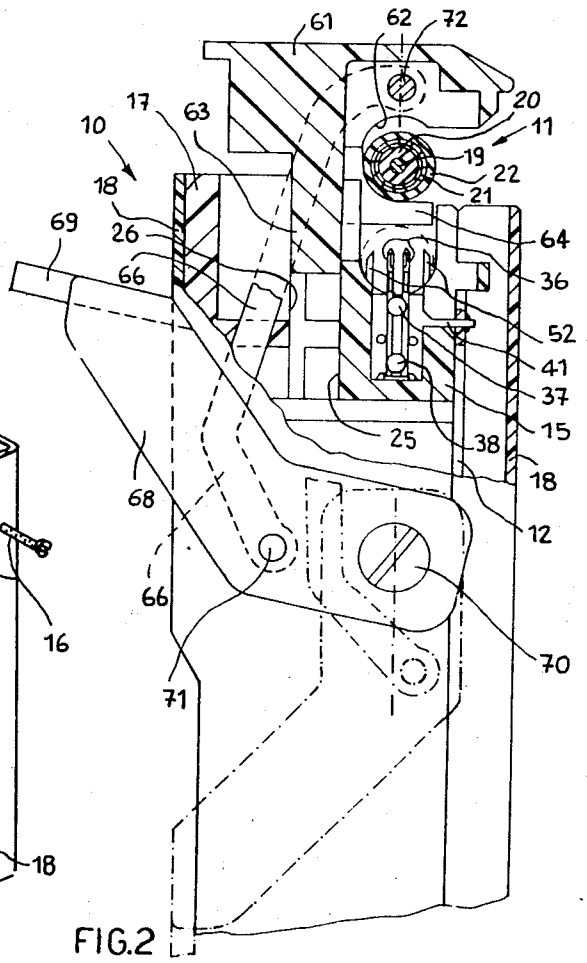
FIG. 2 is a partial side section of the apparatus of FIG. 1.

The connection device includes another jaw 61 (FIG. 1) complementing the jaw 15 and provided with a semicylindrical seat 62 (FIG. 2). The jaw 61 includes a vertical appendage 63 which is guided vertically between the two shoulders 26 of the support 17 and the surface 25 of the block 15 so that the jaw is guided to move parallel to them.

The jaw 61 is provided below with two appendages 64 disposed at the two sides of the block 15 to facilitate the positioning of the device on the cable 11 before connection and to allow extraction of the needles 36 and 52 from the cable 11 when disconnection is desired.

The jaw 61 is actuated by a pair of connecting rods 66 and a two-position lever 67. This is constituted by two arms 68 connected by a crossbar 69 and pivoted on two coaxial pins 70 carried by the support 17. The pivot 71 for the connecting rods 66 on the arms 68 of the lever 67 is disposed in such a position that, on rotation of the lever 67 from the open position of FIG. 2 to the closed position outlined in FIG. 2, it is carried over dead centre i.e. beyond the conjunction of the centre of the pins 70 with the pivot 72 of the connection rods 66 on the jaw 61 so that the closed positon is made stable.

The transceiver 10 can be connected to any pivot of the cable 11 accessible from outside. For this purpose, with the lever 67 in the position of FIG. 2, the jaw 61 is disposed on the cable 11 which is thus positioned between the semicylindrical recess 62 and the appendages 64.

The lever 67 is then turned so that by means of the connecting rods 66 the jaw 15 is approached. The needles 36 and 52 (FIG. 4) then engage the cable 11, piercing its insulation. In particular the needles 52 of each element 51 pierce the outer insulation 22 and engage the braid 21 at two diametrically opposed regions. The needles 36 pierce in turn the insulation 22, the braid 21, and the insulation 20, carrying the insulated portions 44 into correspondence with the braid 21. The needles 36 engage, with the angle of the region 43, two diametrically opposed regions of the central conductor 19 of the cable 11, which forces the two needles 36 slightly outwards, causing them to bend from the pivot pins 40.

Thus effective contact of the needles 36 with the conductor 19 is guaranteed without tending to cause bending of the latter. The lever 67 (FIG. 2) is rotated until the pivot 71 snaps over dead centre into the stable position outlined in FIG. 2.

Whenever one wishes to disconnect the transceiver 10, for example to connect it to another point of the cable 11, it is only necessary to open the jaw 61 by turning the lever 67 from the closed position to the position in continuous line in FIG. 2. The appendages 64 of the jaw then draw the cable 11 off the needles 36 and 52. Becuase of the elasticity of the two layers 20 and 22 of insulation, the holes substantially close up and the cable 11 is not damaged, while the transceiver 10 is ready to be connected in the desired position.

Figure 5:
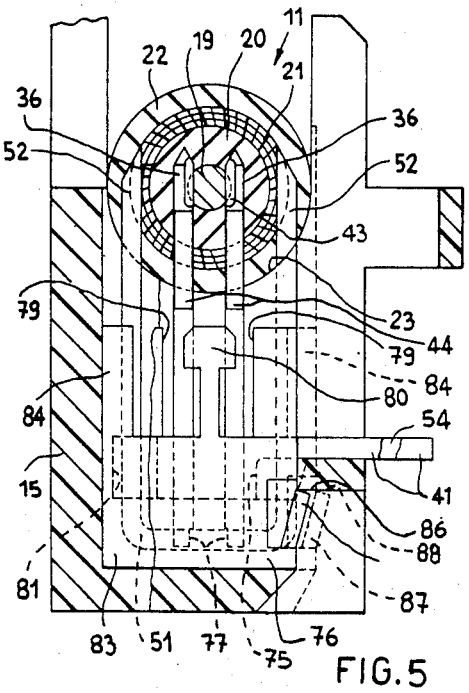
FIG. 5 is a similar section of a modification of the connecting device.

According to the modification of FIG. 5, the appendage 41 for connection to the terminal 42 (FIG. 1) is carried by a strip 75 (FIG. 5) soldered to the two needles 36.

The strip 75 and the needles 36 are incorporated in a block 76 of plastics material such as to be able to be inserted against friction in the slot 27 of the block 15 (FIG. 3), until a tab 85 snaps under a shoulder 86.

In particular the needles 36 (FIG. 5) are provided with an orientating offset 77 and are arranged in the forming mould of the block 76 together with the strip 75, after the plastics material is injected. The block 76 has two recesses 79 which define a central appendage 80 for guiding and supporting the needles 36.

The appendage 54 for connection to the terminal 56 (FIG. 1) of the card 12 is in turn carried by a strip 81 similar to the strip 75. The U-elements 51 are connected to the strip 81 by soldering and are incorporated in another block 83 of plastics material 83, in a similar manner to that seen for the block 76.

The block 83 has two appendages 84 for guiding and supporting needles 51 and is adapted to be inserted in the slots 28 and 29 of the block 15 until a tab 87 snaps under a shoulder 88.

Figure 6:
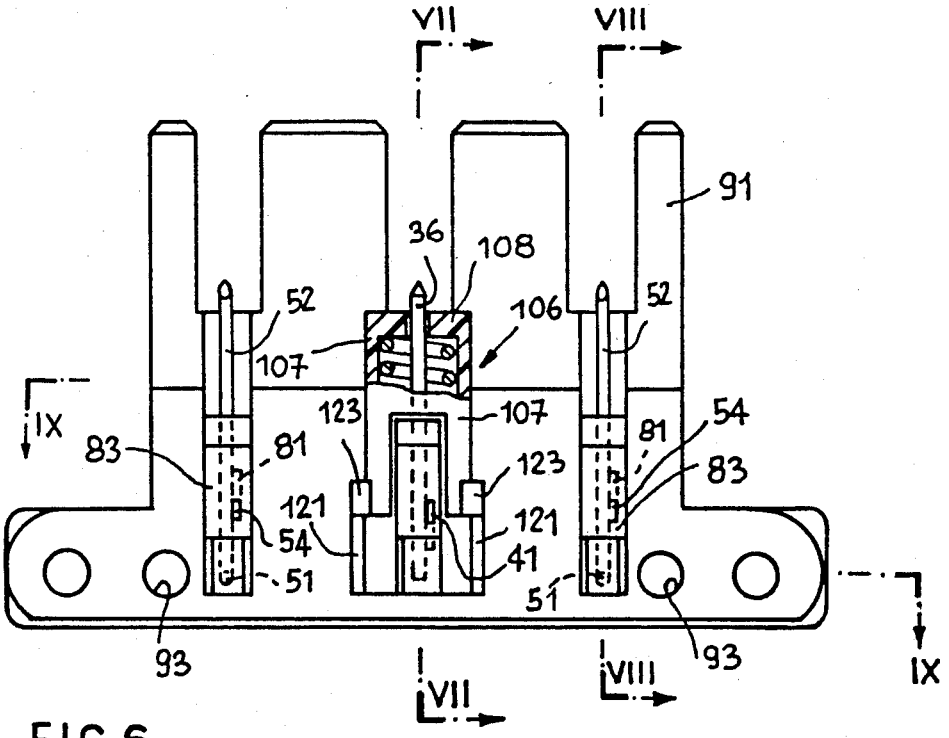
FIG. 6 is a partial side section of another modification of the device.
Figure 9:
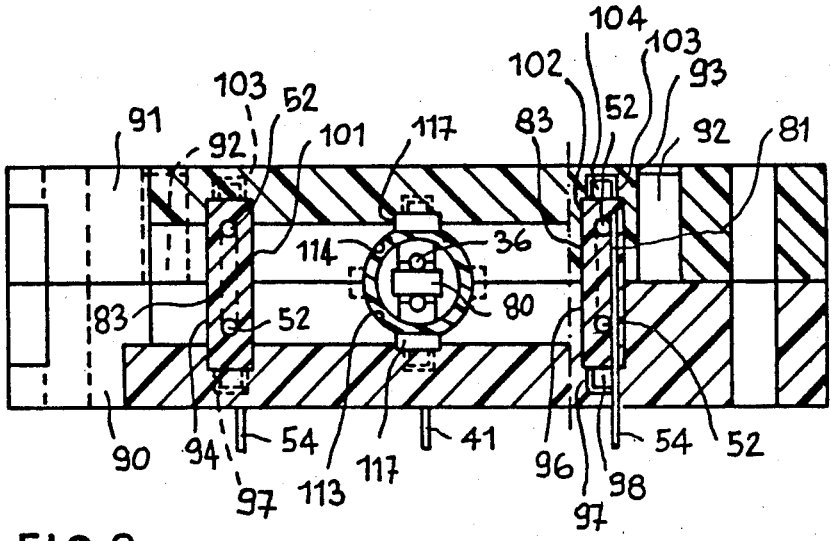
FIG. 9 is a section taken at the line IX—IX of FIG. 6.

According to another modification of the connection device, the block 15 is formed from two parts 90 and 91 (FIG. 9) of plastics material facing one another and connected by pressing by two pins 92, integral with the part 90, which engage two corresponding locations 93 in the part 91. The pins 92 and/or the locations 93 (FIG. 6) can be so formed as to connect the two parts by snapping together, by for example forming the pins with an axial slot and with a head with a larger diameter.

Figure 8:
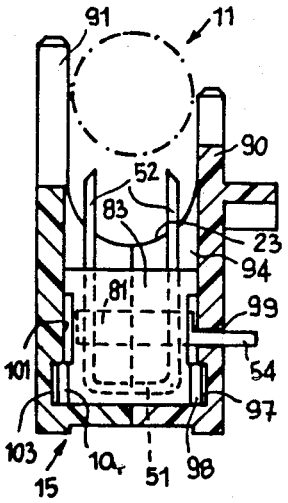
FIG. 8 is a transverse section of the device at the line VIII—VIII of FIG. 6.

The part 90 of the block 15 is formed with two seats 94 and 96 (FIG. 9) each adapted to receive one half of one of the blocks 83 from which the appendage 54 projects. Each seat 94 and 96 comprises a channel 97 for receiving a prismatic projection 98 of the block 83 (FIG. 8) and a hole 99 for allowing the appendage 54 to pass through. In a corresponding manner the part 91 of the block 15 is formed with two seats 101 and 102 each adapted to receive the other half of one of the blocks 83 and comprising a channel 103 for holding, through another prismatic projection 104, each block 83 in the respective seat 101 or 102.

Figure 10:
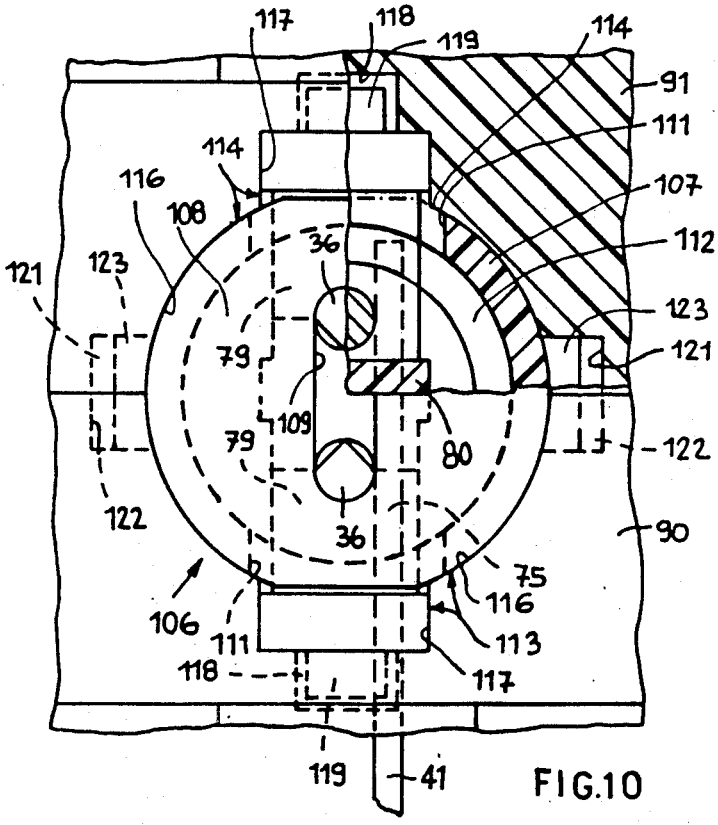
FIG. 10 is a view on a larger scale of a detail of FIG. 9.

To keep the spacing of the needles 36 rigorously constant during the piercing of the cable 11, the needles are guided in the vicinity of the cable itself by a support generally indicated by 106 (FIG. 7), which slides perpendicularly to the seat 23 of the block 15. In particular the support 106 takes the form of a hollow cylinder 107 closed at the top by a wall 108. This is provided with a slot 109 (see also FIG. 10) in which the needles 36 engage, and which therefore cannot open out during piercing. The cylinder 107 is moreover provided with two axial slots 111 (FIG. 7) by means of which the cylinder 107 is engaged with the recesses 79 of the block 76. A compression spring 112 disposed between the bottom of the recesses 79 and the wall 108 tends to push the latter towards the free ends of the needles 36.

The assembly constituted by the block 76 with the needles 36, the cylinder 107 and the spring 112 is accommodated in two seats 113 and 114 (FIG. 9) of the two parts 90 and 91. These seats comprise a cylindrical portion 116 for the cylinder 109 and a prismatic portion 117 for the two ends of the block 76. Each portion 117 is moreover provided with a channel 118 (FIG. 7) for receiving a corresponding locking prismatic projection 119 provided on each end of the block 76. The part 90 is provided with a hole 120 to allow the appendage 41 of the strip 75 to pass through the part 90.

Finally the two seats 113 and 114 of the parts 90 and 91 are provided with two recesses 121 and 122 in which two prismatic appendages 123 (FIG. 10) of the cylinder 107 are engaged so as to prevent rotation of the cylinder 107 in the seats 113 and 114 and to determine its stroke.

Figure 7:
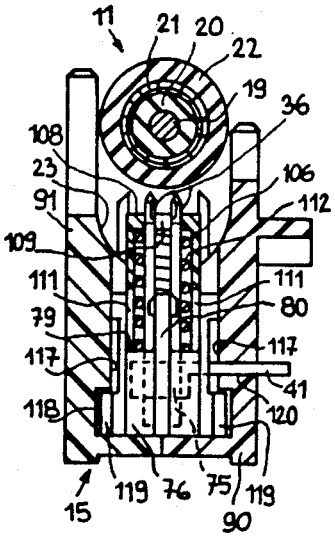
FIG. 7 is a transverse section of the device, taken at the line VII—VII of FIG. 6.
Figure 11:
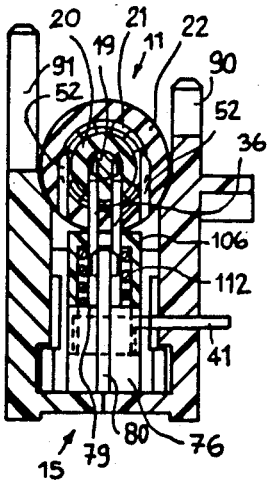
FIG. 11 is a section of FIG. 7 in the working position.

At rest the cylinder 107 is in the high position indicated in FIG. 7. When the jaw of the connection device is closed, the cable 11 is pressed against the needles 36 and 52 in the seat 23 of the block 15. First the needles 36 pierce the insulation 22 of the cable 11, while the wall 108 of the cylinder 107 prevents them from spreading outwards under the lateral force. As the pressing of the cable 11 towards the seat 23 continues, the cable 11 engages the wall of the cylinder 107 and causes the latter to slide into the seat 113 and 114 against the action of the spring 112. When the needles 36 engage the conductor 19, they are guided by the wall 108 in the vicinity of the respective free ends so that these can cut into the conductor 19 as far as the position indicated in FIG. 11 without being opened out by the greater force required for such cutting, and guaranteeing excellent electrical contact.

As seen above it it evident that the arrangement of all the needles on the same side of the cable makes rapid connection using jaws possible by means of a snap-over lever. It is evident that the connection device described can undergo various other modifications and improvements within the scope of the invention as claimed. In particular the needles 36 and 52 can be incorporated directly in the block 15, thereby eliminating the blocks 76 and 83.

I claim:

1. A device for connecting a logic circuit to a coaxial cable having a center conductor, a screening conductor and an insulation layer between said center conductor and said screening conductor, said device including a frame mounting a support for said logic circuit, a fixed jaw secured to said frame and having a partially cylindrical seat for said cable, a pair of insulation-piercing parallel needles located in said seat in a plane perpendicular to the axis of said cable and electrically connected to said logic circuit, said needles being spaced by a distance corresponding to the diameter of said center conductor, a complementary jaw guided on said frame for movement relative to said fixed jaw, and snap-over means manually operable for causing said complementary jaw to force said cable on said needles to cause said needles to pierce said screening conductor and said insulation layer and to contact said center conductor, said needles having an insulated middle portion to extend when in use through said screening conductor.

2. A device according to claim 1, wherein said needles are substantially cylindrical and are made of metallic resilient material having an end conical point, said middle portion being insulated by a layer of insulating material, said needles having a partly prismatic portion between said middle portion and said conical point, said partly prismatic portion being formed of a pair of plane faces forming a corner edge parallel to the axis of the needle, said needles being symmetrically located at a mutual distance slightly less than said diameter to engage said center conductor with said corner edge.

3. A device according to claim 1, characterized in that the complementary jaw is guided on said frame for parallel movement and the manual means include two-position lever connected to the complementary jaw by a connecting rod which in the closed position is slightly beyond dead center so that the closed position is stable.

4. A device according to claim 1, characterized in that the complementary jaw includes appendages which carry the cable as it is forced on the needs by the complementary jaw, said appendages pulling the cable off the needles when the complementary jaw is retracted from the fixed jaw.

5. A device according to claim 1, wherein said cable includes an outer insulation comprising a pair of conductor elements located in the fixed jaw of said frame so as to flank said needles and to be caused by said complementary jaw to pierce said outer insulation and to contact said screeing conductor from the same side of said needles at a position spaced along said cable from said needles.

6. A device according to claim 5, characterized in that the conductor elements are equidistant from the pair of needles, each of the conductor elements being constituted by a U-member ending in two parallel needles spaced to correspond to the diameter of the screening conductor.

7. A device according to claim 6, characterized in that the jaws include a jaw fixed relative to the circuit and carrying the needles in a cylindrical seat for the cable.

8. A device according to claim 7, characterized in that the fixed jaw has three slots, one accommodating the first said needles and the other two accommodating the other two conductor elements.

9. A device according to claim 8, characterized in that the needles are fixed to a metal strip soldered to the circuit.

10. A device according to claim 9, characterized in that the conductor elements and the said strip are incorporated in a plastic moulding and removably disposed in the respective slots, said moulding being carried by said frame.

11. A device according to claim 1, characterized in that the needles are guided in the vicinity of the cable by a support sliding on the needles and holding the needles at a fixed spacing as they pierce the cable.

12. A device according to claim 11, characterized in that the support has the form of a hollow cylinder and slides along its own axis, a compression spring being provided to push the support towards the cable.

13. A device according to claim 12, characterized in that the needles are connected to a metal strip for connection to the circuit, the needles and the metal strip being incorporated in a plastic moulding, and the spring being disposed between the cylinder and the moulding.

14. A device according to claim 13, characterized in that the fixed jaw is formed in two making parts provided with seats to receive the cylinder and mouldings carrying the needles and conductor elements, the said parts being connectable to one another by snap or press-fit correcting means.

* * * * *